US007057357B2

(12) United States Patent
Chang

(10) Patent No.: US 7,057,357 B2
(45) Date of Patent: Jun. 6, 2006

(54) RAPID WARMUP LIGHT ACTUATOR

(75) Inventor: Ching-Chung Chang, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 10/862,354

(22) Filed: Jun. 8, 2004

(65) Prior Publication Data

US 2005/0057163 A1 Mar. 17, 2005

(30) Foreign Application Priority Data

Sep. 17, 2003 (TW) ..... 092125592

(51) Int. Cl.
*H05B 37/00* (2006.01)

(52) U.S. Cl. ..... 315/224; 315/291

(58) Field of Classification Search ..... 315/224, 315/225, 291, 307, 308, 209 R, 219, 244, 315/276, 360, 362
See application file for complete search history.

(56) References Cited

U.S. PATENT DOCUMENTS

| | | | | |
|---|---|---|---|---|
| 5,581,158 | A * | 12/1996 | Quazi | 315/921 |
| 5,770,925 | A * | 6/1998 | Konopka et al. | 315/225 |
| 5,907,742 | A | 5/1999 | Johnson et al. | 399/51 |
| 6,281,636 | B1 * | 8/2001 | Okutsu et al. | 315/209 R |
| 6,429,603 | B1 * | 8/2002 | Tsugita et al. | 315/224 |
| 6,853,155 | B1 * | 2/2005 | Yamamoto et al. | 315/291 |
| 6,906,473 | B1 * | 6/2005 | Alexandrov | 315/224 |

* cited by examiner

*Primary Examiner*—Wilson Lee
(74) *Attorney, Agent, or Firm*—Birch,Stewart,Kolasch & Birch,LLP

(57) ABSTRACT

A rapid warmup light actuator is disclosed to solve the problems that the light actuator cannot rapidly warm up the lighting load in the prior art and that unstable light sources result from the rapid temperature drop if the light is instantaneously disconnected and restarted. The device consists of an energy storage circuit, an oscillatory circuit, and a transformer. In the beginning of power supply, the energy storage circuit is charged. When starting the lighting load, the energy stored in the energy storage circuit rapidly warms up the lighting load in order to illuminate stable light. Using the energy stored in the energy storage circuit, the lighting load can continue its stable status even it is instantaneously disconnected and restarted.

17 Claims, 7 Drawing Sheets

(Original Luminance Warm Up Curve)

(Fast Luminance Warm Up Curve)

(Luminance Warm Up and Cool Down Curve)

(Luminance Warm Up and Cool Down Curve)

(Drive with Higher Energy)

RAPID WARMUP LIGHT ACTUATOR

This Non-provisional application claims priority under 35 U.S.C. § 119(a) on Patent Application No(s). 092125592 filed in Taiwan on Sep. 17, 2003, the entire contents of which are hereby incorporated by reference.

BACKGROUND OF THE INVENTION

1. Field of Invention

The invention relates to a light actuator and, in particular, to a light actuator that can rapidly warm up a lighting load and keep it illuminating in a stable way.

2. Related Art

The cold cathode fluorescent lamp (CCFL) has wide applications. For example, it is used as the backlit source of liquid crystal display (LCD) screens, in scanners, and in multiple function peripherals (MFP). Other applications such as the transparent media adaptor (TMA), the scan of negative film or XPA also use the CCFL as the light source.

Since the CCFL requires an extremely high voltage (about several hundred volts) when it is started and working, the driving device or inverter has to be able provide such a high-voltage output. The output power quality of the driving device determines the lighting quality and stability of the CCFL.

To ensure the quality of the light source, the temperature of the CCFL has to reach a certain temperature. Therefore, normal scanners have to spend some time to warm up the CCFL after it is turned on. This is why the CCFL of many existing scanners requires a warmup time of about three minutes. In colder areas or environments, the warmup time may be even longer.

Therefore, methods for rapidly warming up the CCFL have been proposed. For example, in the U.S. Pat. No. 5,907,742 uses a dual input voltage control method. That means a higher input voltage (about 12V) is used to make the temperature of the CCFL quickly rise to its work temperature. A lower input voltage (about 8V) is then used after the warmup. Although the method can reduce the CCFL's warmup time down to about 30 seconds, it nevertheless makes the CCFL to sustain a higher current during the warmup time, thereby resulting in a shorter lifetime.

Secondly, to have two different input voltages (for warmup and work times), it uses a pulse width modulation control circuit to control the input voltage. Their circuit design is more complicated.

Moreover, the above-mentioned patent uses the frequency oscillator built in the inverter. The oscillatory frequency often drifts randomly between 35 and 45 kHz under different voltages and temperatures. Consequently, the lighting may become unstable and thus affect the scanning quality.

Another rapid warmup method is to install a NiCr wire coiling around the CCFL. Using the heat generated by the NiCr wire, the lamp tube is forced to raise its temperature. Although this method can achieve the goal of rapidly warming up the CCFL, the addition of the NiCr wire complicates the manufacturing process. Secondly, the NiCr wire also increases the cost, including the equipment and power consumption. The most serious problem is the light blocking by the heating wire around the lamp tube. Therefore, the light intensity of the CCFL is inhomogeneous and affects the scanning quality. Furthermore, the NiCr wire is fragile and thus increases the maintenance cost.

Therefore, current methods of rapidly warming up the CCFL have their own limitations and problems. It is an important subject of the field how to rapidly warm up the CCFL at the same time elongating its lifetime and maintaining a stable light source.

SUMMARY OF THE INVENTION

In view of the foregoing problems, an objective of the invention is to provide a rapid warmup light actuator. The disclosed light actuator designs a temperature lowering curve according to the natural warmup curve of the lighting load to be started. Using the rising and lowering curves, an energy storage circuit and the oscillatory circuit in the light actuator are designed to reduce the time for the lighting load to become a stable light source. When the light is instantaneously turned off and restarted, it can continue sending out stable light.

To achieve the above objective, the disclosed rapid warmup light actuator has an energy storage circuit, an oscillatory circuit, and a transformer. In the beginning of the power supply, the energy storage circuit is charged so that the energy stored in the energy storage circuit rapidly warms up the lighting load for stable illumination.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

Figure 5:
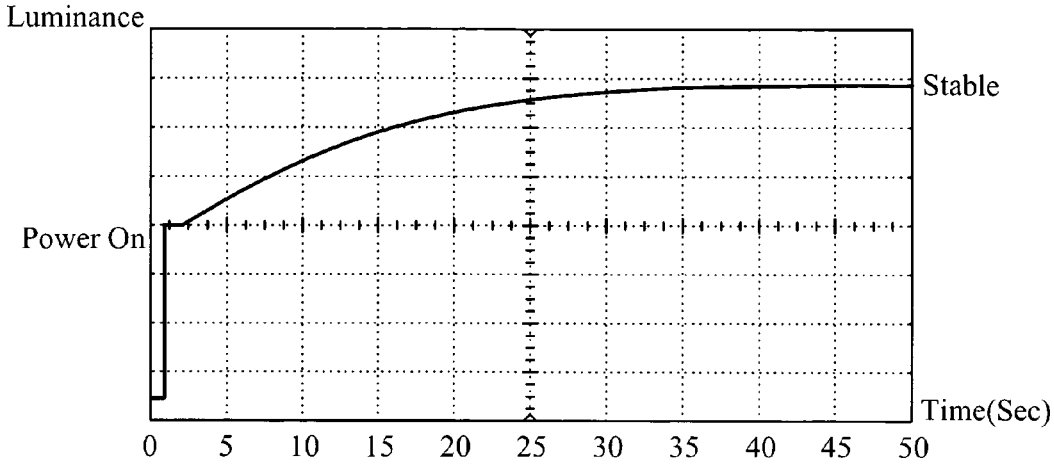
FIG. 5(PRIOR ART)
FIG. 5 shows the relation between starting time and brightness of the CCFL using the inverter in the prior art.

We first explain the main idea of the invention. We take the CCFL of a lighting load as an example. FIG. 5 shows a temperature rising curve of a normal CCFL that is naturally warmed up. The horizontal X-axis is labeled in units of 5 seconds; the Y-axis shows the brightness. One sees from the plots that it takes about 50 seconds for the lighting load to reach its stable illumination. The invention finds a temperature lowering curve corresponding to the temperature rising curve. They are symmetric about the X axis. Since the sum of the temperature rising curve and the temperature lowering curve is a constant, we take the cross point of the two curves as a balance time. An energy storage circuit is designed accordingly so that the lighting load started by the disclosed inverter can rapidly reach stable illumination. Moreover, the stable illumination can be maintained after the lighting load is instantaneously disconnected and restarted. This is because the energy storage circuit can generate a lowering curve.

Figure 1:
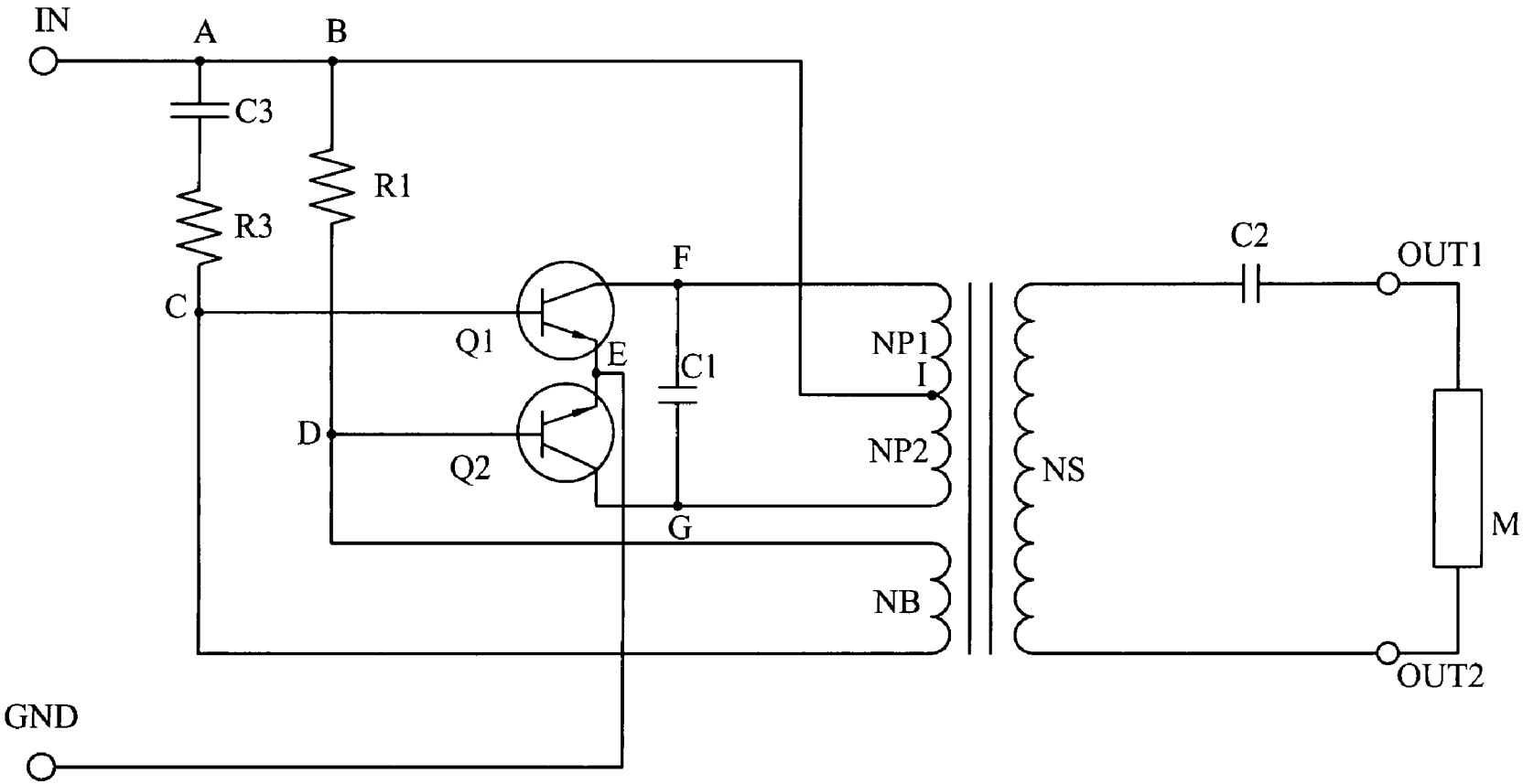
FIG. 1 shows a first embodiment of the disclosed rapid warmup light actuator.

Please refer to FIG. 1 for a preferred embodiment of the invention. It includes an energy storage circuit, an oscillatory circuit, and a transformer. The light actuator has a power input terminal IN, a ground terminal GND, and output terminals OUT1, OUT2. Between the power input terminal IN and the connecting point A, there can be additionally designed capacitor or spike protection circuits for filtering or a switch that controls the light actuator.

The energy storage circuit is connected between point A and point C. It is made of a voltage storage device C3 and an impedance R3. According to a preferred embodiment, it is an RC circuit consisting of capacitors and resistors, such as the third capacitor C3 and the third resistor R3 shown in the drawing. The RC circuit is selected according to the temperature rising and temperature lowering curves of the lighting load; otherwise, the device cannot achieve the expected goal of rapid warmup. In addition, the energy storage circuit is connected with a first resistor R1 in parallel.

An oscillatory circuit is connected among points A, D, F, and G. It includes a first transistor Q1, a second transistor Q2, and a first capacitor C1. The base of the first transistor Q1 connects to point C and one end of the coil NB. The other end of the coil NB connects to the base of the second transistor Q2. The common input point I of the coils NB1, NB2 connects to point A so that power can be supplied through point I. The emitters of the first transistor Q1 and the second transistor Q2 connects to point E and the ground GND. The collector of the first transistor Q1 connects to the other end of the coil NP1 through point F. The collector of the second transistor Q2 connects to the other end of the coil NP2. Both collectors connect to the first capacitor C1 in parallel at points F and G. The coil NS of the output terminal connects to a second capacitor C2 in series. The output terminal OUT1 and OUT2 connects to a lighting load M in parallel. The power is supplied to the base of the first transistor Q1 via the input terminal IN. The voltage between points C and E varies. Therefore, the on and off of the first transistor Q1 change with the pulse variation of the power input. The first transistor Q1 and the second transistor Q2 are disposed in a symmetric way, and so are the coil NP1 and the coil NP2. The symmetry will be broken when the power supply sends in a high voltage. Consequently, the voltages on point F and point G are different. The input voltage is converted by the coils N1, NP2 into an alternate output voltage. If the power supply sends a low voltage (usually 0), the work voltage or output voltage Vout is also zero because of the unbroken symmetry.

When the power supply sends a voltage to point C, the first transistor Q1 and the second transistor Q2 become a switch so that the input voltage is converted into the work voltage. Therefore, an output voltage Vout is obtained through the transformer conversion. The main function of the second capacitor C2 is to stabilize the output voltage Vout. In the following paragraphs, we describe the operation principles of the invention. Before the inclusion of the energy storage device, when the power is supplied from the input terminal, the oscillatory frequency output by the oscillatory circuit composed of the first transistor Q1 and the second transistor Q2 is converted by the transformer made of the coils NP1, NP2, NB, and NS into an appropriate output voltage. In this case, the lighting load M is started. Under this circuit structure, the lighting load requires a longer time to illuminate in a stable way.

Once the energy storage circuit (composed of the third resistor R3 and the third capacitor C3), the first transistor Q1 and the second transistor Q2 continuously switch between on and off to output an oscillatory frequency. The energy stored in the energy storage circuit is immediately supplied to the transistors without delay. This can shorten the time for the lighting load M to reach its stable illumination. When the circuit is instantaneously shut down, the light load M is off. Due to its properties, the lighting load M rapidly cools down. If the inverter restarts the lighting load M, it has to return to its original stable state. At this moment, the energy stored in the energy storage circuit does not disappear immediately because of the discontinuity of electrical power. Therefore, the stored energy can be quickly supplied to the transistors once the system restarts. The temperature of the lighting load M therefore does not drop too quickly.

Figure 2:
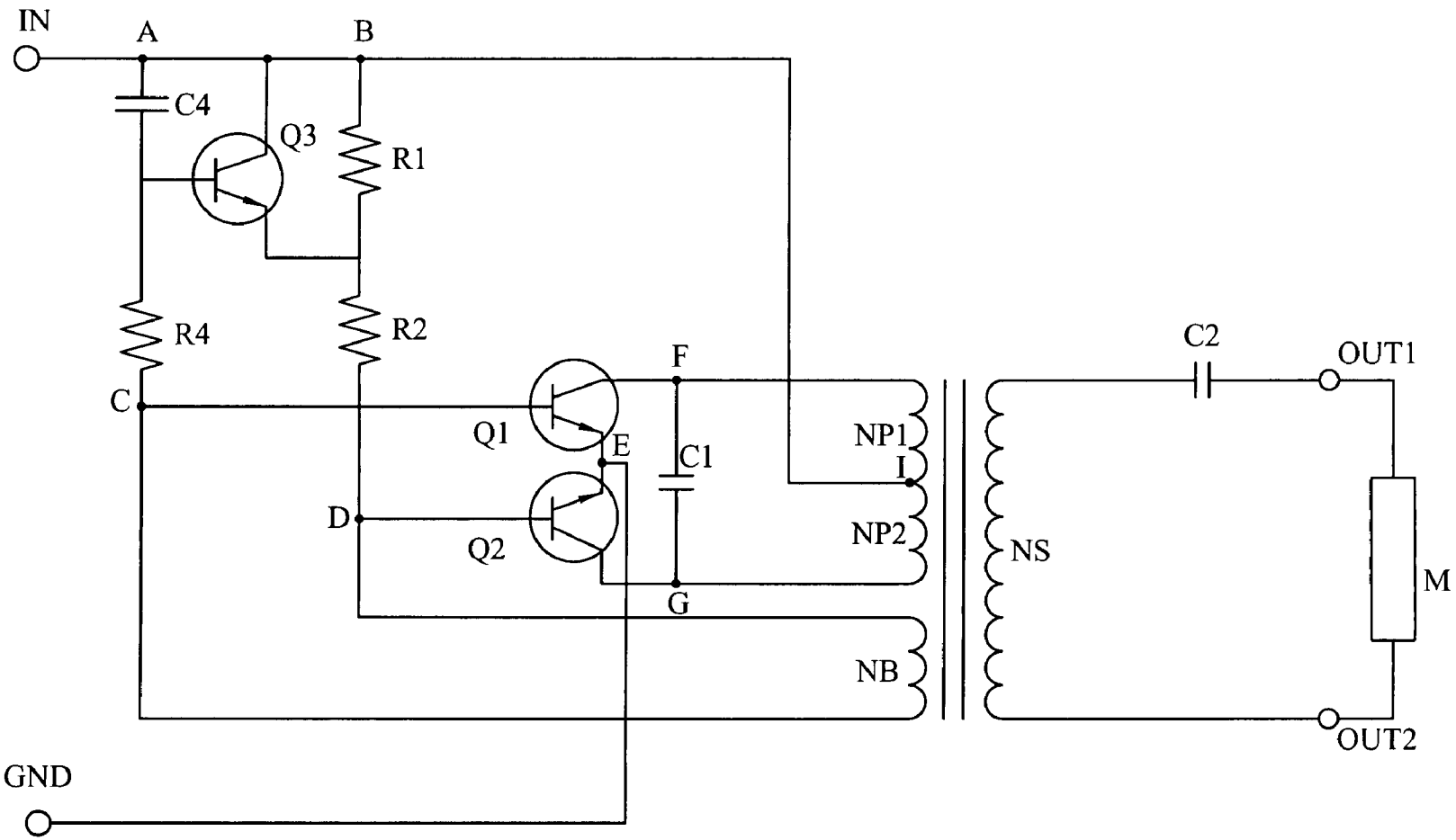
FIG. 2 shows a second embodiment of the disclosed rapid warmup light actuator.

FIG. 2 shows a second embodiment of the disclosed inverter. In practice, one has to take into account the size of the voltage storage device in the energy storage circuit. Voltage storage devices of different capacities have different effects. Taking the capacitor elements as an example, the larger capacitance it has the larger size it will be. Due to the space limit, one usually uses a capacitor with a smaller capacitance. As shown in the drawing, the energy storage circuit is comprised of a fourth capacitor C4 and a fourth resistor R4, connected in parallel with a third transistor Q3 to amplify the voltage released from the fourth capacitor C4. The base of the third transistor Q3 connects between the fourth capacitor C4 and the fourth resistor R4. The collector connects to point A. The emitter connects to point D, the base of the second transistor Q2, via a second resistor R2

The operation principles of the second embodiment are the same as the first embodiment. The only difference is that the second embodiment can use a capacitor with a smaller capacitance and the voltage stored in the capacitor is amplified by a transistor.

Figure 3:
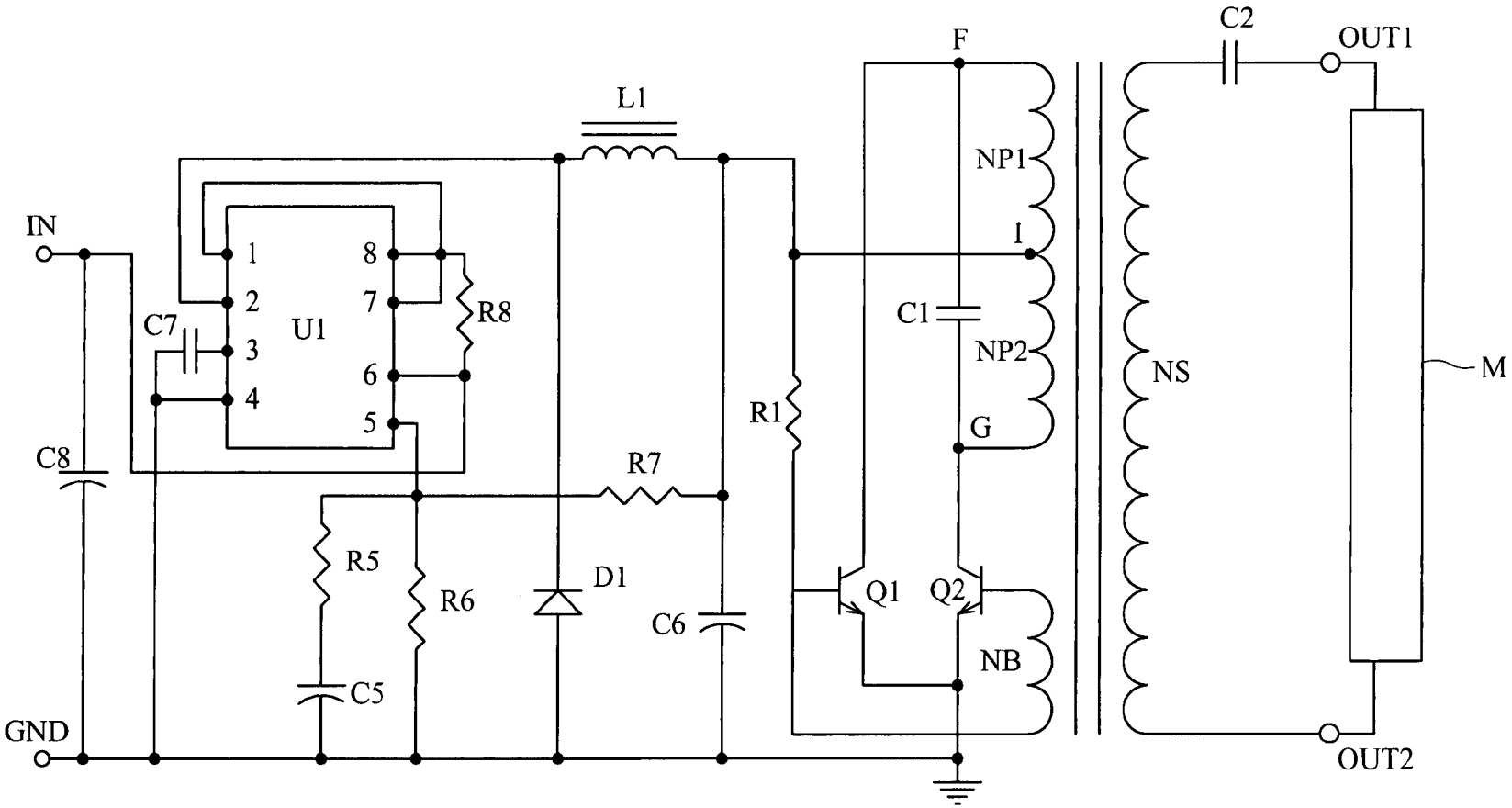
FIG. 3 shows a third embodiment of the disclosed rapid warmup light actuator.

Please refer to FIG. 3 for a third embodiment. Consider the situation when the input voltage is higher and the inverter needs a lower voltage. For example, when the input voltage is over 24V while the inverter only requires a 12V input. In this case, one can use the inverter disclosed here. As shown in the drawing, a voltage-lowering device, such as the MC34063 microprocessor, can be used along with the disclosed energy storage circuit. The energy storage circuit is comprised of the fifth resistor R5 and the fifth capacitor C5, connected in parallel with necessary circuits such as the sixth resistor R6, a first diode D1, and a sixth capacitor C6. The fifth resistor R5 is connected to a seventh resistor R7 in series. One end of the fifth capacitor C5 connects to the ground GND. The microprocessor U1 can be an integrated circuit (IC) with eight pins. As shown in the drawing, a seventh capacitor C7 is connected between the third pin and the ground GND. The fourth pin directly connects to the ground. The voltage input terminal connects to the sixth and eighth pins and couples to an eighth resistor R8. An eighth capacitor C8 is coupled between the voltage input terminal and the ground terminal. The input voltage after the voltage drop is output via the second pin. The output voltage passes through a first inductor L1. Through the energy storage circuit made of the fifth resistor R5 and the fifth capacitor C5, and the on and off of the first transistor Q1 and the second transistor Q2, the lighting load M is started.

Figure 4:
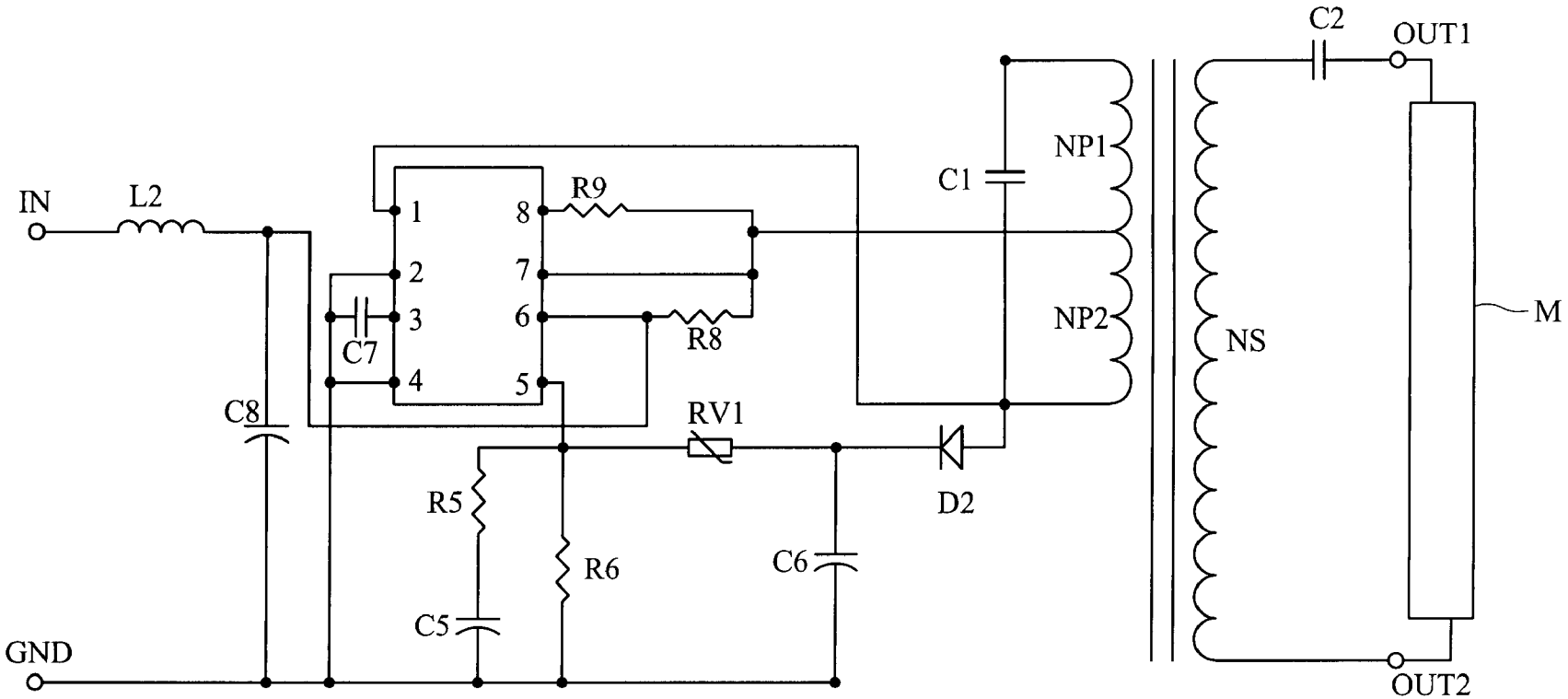
FIG. 4 shows a fourth embodiment of the disclosed rapid warmup light actuator.

A fourth embodiment of the invention is shown in FIG. 4. In this embodiment, one does not need the first transistor Q1 and the second transistor Q2 as the elements in the oscillatory circuit. A microprocessor U1 is also used to provide an oscillatory frequency and voltage drop. It can again be an eight-pin IC with pins shown in the drawing. A seventh capacitor C7 is connected between the third pin and the ground GND. The second and fourth pins directly connect to the ground. An eighth resistor R8 and a ninth resistor R9 are connected in series between the sixth and eights pins. The seventh pin is coupled between the eighth resistor R8 and the ninth resistor R9. The fifth pin connects to the ground via the sixth resistor R6. A second inductor L2 and a ninth capacitor C9 are coupled between the voltage input terminal and the ground. The voltage is supplied between the second inductor L2 and the ninth capacitor C9 to the sixth pin of the microprocessor U1. The oscillatory frequency generated after the voltage drop is output via the first pin.

The energy storage circuit is comprised of the fifth resistor R5 and the fifth capacitor C5. It is connected in parallel with a sixth resistor R6 and a sixth capacitor C6. A variable resistor RV1 is connected between the sixth resistor R6 and the sixth capacitor C6. The output energy is sent to point G via the second diode D2. Point I is connected between the eighth resistor R8 and the ninth resistor R9. In the fourth embodiment, the transformer only needs two sets of first-order coils.

Figure 6:
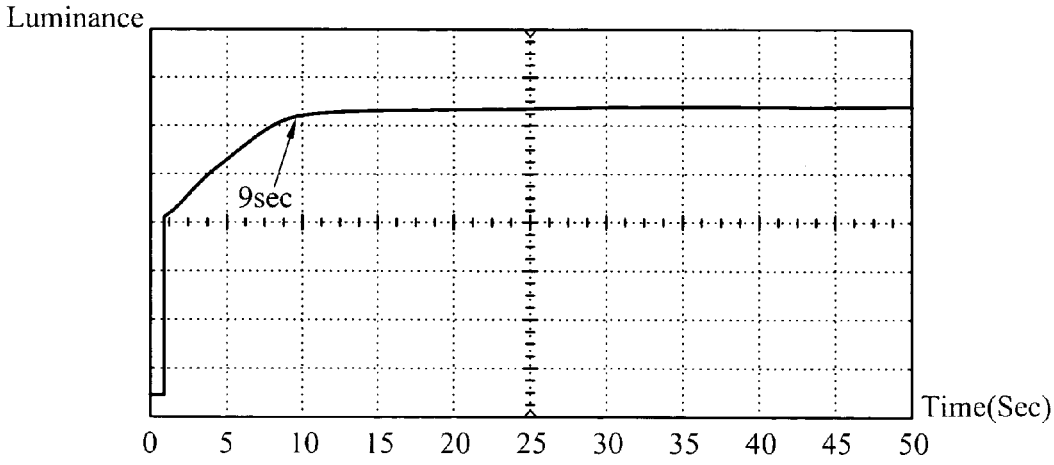
FIG. 6 shows the relation between starting time and brightness of the CCFL using the inverter disclosed in the first embodiment.

The disclosed rapid warmup light actuator uses the CCFL as the lighting load to verify the feasibility of the invention. FIG. 6 shows a temperature rising curve of the CCFL using the disclosed inverter. Comparing the results of FIG. 5 and FIG. 6, one finds that the disclosed inverter can greatly shorten the time to reach stable illumination. When using a 470 μF capacitor and a 2.7K resistor, only 9 seconds are needed. Therefore, a scanning device using the invention can be quickly started without wasting too much to wait.

Figure 7:
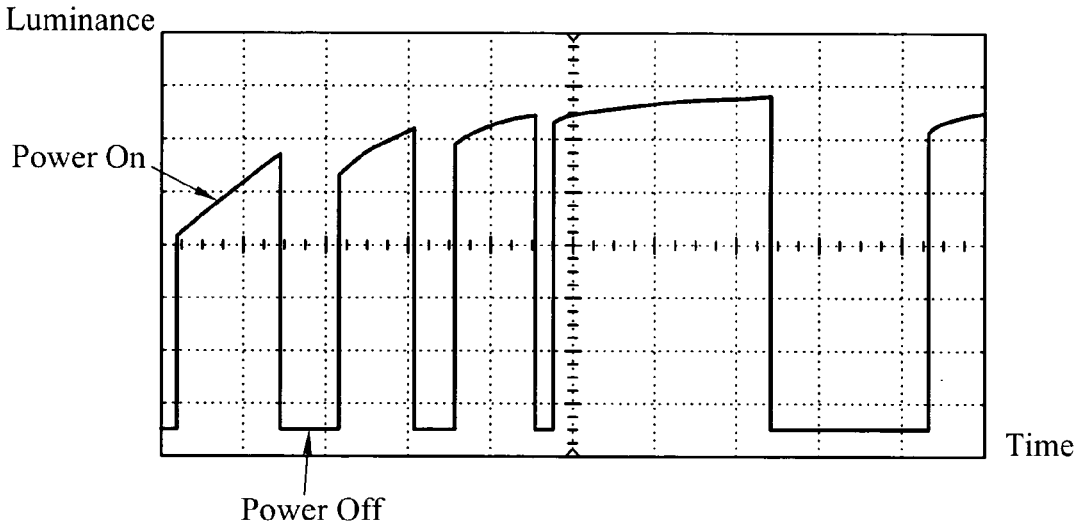
FIG. 7(PRIOR ART)
FIG. 7 shows the relation between restarting time and brightness of the CCFL using the inverter disclosed in the prior art.
Figure 8:
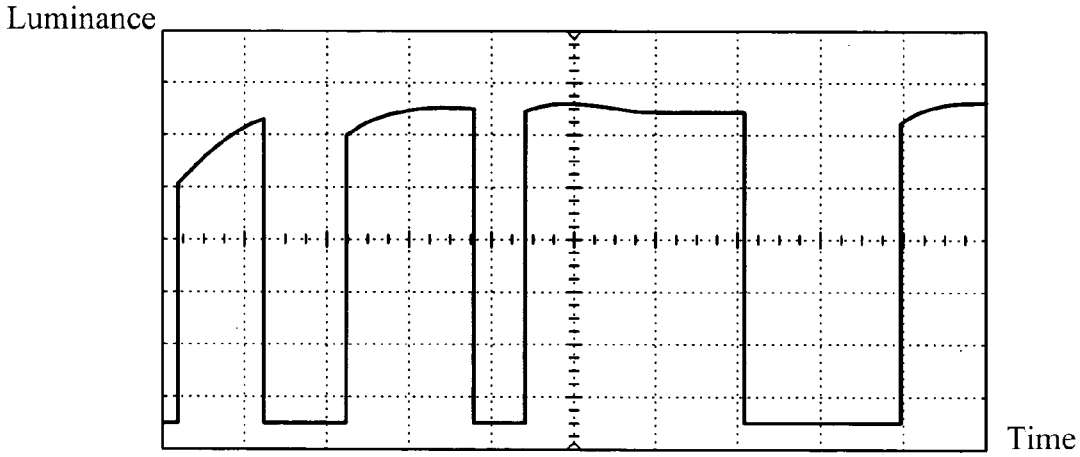
FIG. 8 shows the relation between restarting time and brightness of the CCFL using the inverter disclosed in the first embodiment.

As to the continuous performance, please refer to FIG. 7 and FIG. 8. FIG. 7 shows the relation between the restarting time and brightness when using the inverter in the prior art. It is obvious that the brightness rapidly drops when the circuit is suddenly shut down. However, as shown in FIG. 8, the continuity in instantaneous shutdown is better once lighting load has been illuminating in a stable state.

Figure 9:
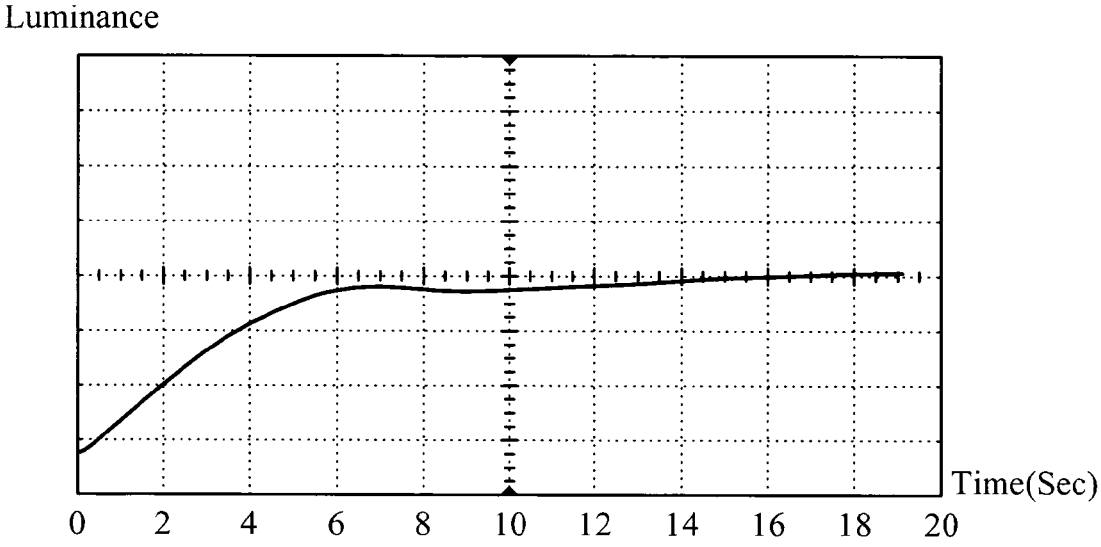
FIG. 9 shows the relation between restarting time and brightness of the CCFL using the inverter disclosed in the second embodiment.

For the second embodiment of the invention, the relation between time and brightness is given in FIG. 9. We see that the stabilizing time is as short as six seconds.

Certain variations would be apparent to those skilled in the art, which variations are considered within the spirit and scope of the claimed invention.

What is claimed is:

1. A light actuator for starting a lighting load, which comprises:
   - an oscillatory circuit, which outputs an oscillatory frequency from a direct current (DC) power;
   - a transformer, which connects to the oscillatory circuit in parallel and output an alternate current (AC) voltage to drive the lighting load at the oscillatory frequency;
   - an energy storage circuit, which is connected in series between the oscillatory circuit and the power input terminal for storing energy and for using the stored energy to maintain stable illumination of the lighting load when the light actuator starts to restarts after an instantaneous shutdown.

2. The light actuator of claim 1, wherein the energy storage circuit further comprises a voltage storage device and an impedance device connected in series.

3. The light actuator of claim 1, wherein the energy stored in the energy storage circuit is determined by the temperature rising curve of the lighting load.

4. The light actuator of claim 1 further comprising a third transistor connected in parallel with the energy storage circuit.

5. The light actuator of claim 1, wherein the oscillatory circuit further comprises a first transistor and a second transistor connected in series.

6. The light actuator of claim 4, wherein the oscillatory circuit further comprises a capacitor connected in parallel with the first transistor and the second transistor.

7. The light actuator of claim 1, wherein the output terminal of the transformer is connected in series with a capacitor.

8. A light actuator for starting a lighting load, which comprises:
   - a microprocessor, which drops the voltage of an input voltage;
   - an energy storage circuit, which is coupled to the microprocessor for storing the lowered input voltage;
   - an oscillatory circuit, which outputs an oscillatory frequency according to the lowered input voltage; and
   - a transformer, which is connected to the oscillatory circuit in parallel to output an AC voltage according to the oscillatory frequency for driving the lighting load;
   - wherein the energy stored in the energy storage circuit keeps the lighting load illuminate in a stable way when the lighting load is started/restarted.

9. The light actuator of claim 8, wherein the energy storage circuit further includes a voltage storage device and an impedance device connected in series.

10. The light actuator of claim 8, wherein the energy stored in the energy storage circuit is determined by the temperature rising curve of the lighting load.

11. The light actuator of claim 8, wherein the oscillatory circuit further comprises a first transistor and a second transistor connected in series.

12. The light actuator of claim 11, wherein the oscillatory circuit further comprises a capacitor connected in parallel with the first transistor and the second transistor.

13. The light actuator of claim 8, wherein the output terminal of the transformer is connected in series with a capacitor.

14. A light actuator for starting a lighting load, which comprises:
   - a microprocessor, which sends out an oscillatory frequency and an output voltage according to an input voltage;
   - an energy storage circuit, which is coupled to the microprocessor for storing the output voltage;
   - a transformer, which is connected to the microprocessor to output an AC voltage according to the oscillatory frequency for driving the lighting load;
   - wherein the energy stored in the energy storage circuit keeps the lighting load illuminate in a stable way when the lighting load is started/restarted.

15. The light actuator of claim 14, wherein the energy storage circuit further includes a voltage storage device and an impedance device connected in series.

16. The light actuator of claim 14, wherein the energy stored in the energy storage circuit is determined by the temperature rising curve of the lighting load.

17. The light actuator of claim 14, wherein the output terminal of the transformer is connected in series with a capacitor.

* * * * *